US005959402A

United States Patent [19]

Polyan

[11] Patent Number: 5,959,402

[45] Date of Patent: Sep. 28, 1999

[54] FLEXIBLE ELECTROLUMINESCENT LIGHT SOURCE

[75] Inventor: Ruben Polyan, 10 Nizhegorodskaya St, Bldg. 1, Apt. 71, 109029 Moscow, Russian Federation

[73] Assignees: Ruben Polyan, Moscow, Russian Federation; Eugene Mushtaev, Millbrae, Calif.

[21] Appl. No.: 08/902,796

[22] Filed: Jul. 30, 1997

[51] Int. Cl.[6] ..... H05B 33/20

[52] U.S. Cl. ..... 313/511; 313/506; 313/509; 313/512

[58] Field of Search ..... 313/502, 506, 313/509, 511, 512, 494

[56] References Cited

U.S. PATENT DOCUMENTS

| | | | |
|---|---|---|---|
| 2,684,450 | 7/1954 | Mager et al. | 313/108 |
| 2,838,715 | 6/1958 | Payne | 315/108 |
| 2,918,594 | 12/1959 | Fridrich | 313/506 |
| 2,928,015 | 3/1960 | Bartels | 313/494 |
| 3,023,338 | 2/1962 | Cerulli | 313/502 |
| 3,052,812 | 9/1962 | Dow | 313/108 |
| 3,278,784 | 10/1966 | Masaharu | 313/511 |
| 3,571,647 | 3/1971 | Robinson | 313/108 |

FOREIGN PATENT DOCUMENTS

| | | | |
|---|---|---|---|
| 2000678 | 4/1993 | Russian Federation | H05B 33/26 |
| 2050042 | 4/1995 | Russian Federation | H05B 33/10 |

*Primary Examiner*—Michael Day
*Attorney, Agent, or Firm*—Ilya Zborovsky

[57] ABSTRACT

An electroluminescent light source has a core member and a pair of transparent band structures between which the core member is sandwiched and which in an assembled state form a transparent sheath. The core is formed by a plurality of elongated electrodes spaced from each other and interconnected by means of connecting bodies of a dielectric material. Spaces between the electrodes are filled with an electroluminescent material which is applied in the form of a film onto the connecting bodies. The entire system of electrodes is placed between a pair of electroconductive buses to which the electrodes are connected electrically and which support the system of electrodes through dielectric separating blocks. In order to provide dynamic light effects (e. g., "traveling light") the electrodes may be combined into separate isolated groups arranged lengthwise or widthwise with electrical connection of each group to a respective electroconductive bus via a switching device. A method of manufacturing of the light source of the invention includes two stages: forming a core and transparent band structures in two separate but simultaneous processes, and assembling the premanufactured units by sandwiching the core between a pair of band structures.

29 Claims, 3 Drawing Sheets

FLEXIBLE ELECTROLUMINESCENT LIGHT SOURCE

FIELD OF THE INVENTION

The invention relates to semiconductor optoelectronics and to lighting engineering, and it can be used in lighted decoration, lighted advertising, show business, optical data displays, cinematography and photography, modern art, new consumer lighting products, medicine, light alarm systems, as well as for light tracing of dark spaces, and for many other applications.

BACKGROUND OF THE INVENTION AND DESCRIPTION OF THE PRIOR ART

Known in the art are electroluminescent emitters (conventional electroluminescent panels ELP), in which one electrode is in the form of aluminum foil and the other electrode comprises a transparent conducting film, with an electroluminescent layer between the electrodes. [see "Elektroluminestsentnye istochniki sveta" (Electroluminescent Light Sources) Ed. by I. K. Vereshchagin, Moscow, Energoatomizdat Publishing House, 1990, p. 51]. If the film electrode is made on a solid base (e. g., of glass), the ELP has a rigid structure. If the film electrode is made on a polymer film (such as polyamide), a flexible panel is obtained.

An advantage of a conventional ELP design is a planar geometry of the structure, in which the electrodes form a planar capacitor, and the electroluminescent layer that fills up the space between the electrodes is in a uniform electric field of the capacitor. Uniformity of the electric field in the electroluminescent layer allows uniform glow of the ELP to be obtained over the entire area, thus assuring maximum brightness. It is possible if a sub-breakdown working voltage $U_{br}$, is chosen so that is limited only by the breakdown voltage Ubr, which does not depend on three-dimensional coordinates, because the field is uniform n the thickness direction of the electroluminescent layer. The design of conventional ELP allows panels of all basic colors to be manufactured in a relatively simple manner, with a low prime cost and high reliability of the products.

However, ELPs of the aforementioned type have a number of disadvantages which result from the problems encountered in forming film electrodes that have to provide high surface areas with uniform properties. These disadvantages limit the possibility of providing long (dozens of meters) planar light sources capable of assuring uniform glow over the entire working area. As the conducting films (e. g., of indium oxide) have high electric resistance (dozens of Ohm per square millimeter), an additional conducting strip (of silver) has to be applied to the edge of the film to assure uniform glow. This complicates the design and manufacture of the ELP. Even under the most favorable conditions such a film electrode absorbs up to 30 to 40% of light radiated by the electroluminescent layer, which is undoubtedly a disadvantage of the ELP from the light efficiency point of view. Another disadvantage of the ELP of the above type is the use of the second electrode of aluminum foil, which is not transparent. This also reduces the total light efficiency, the ELP glow being one-sided (light is emitted through the transparent film electrode only, which in certain applications imposes restrictions upon utilization of such light sources.

Another type of prior art devices is represented by flexible electroluminescent light sources (FLS). In these devices the electrodes are in the form of small-gage conductors (wires), whereby it becomes possible to dispense with the film electrodes and thus to eliminate the disadvantages inherent in the light sources associated with the use of the film electrodes.

Earlier FLS designs with "wire electrodes" are disclosed in U.S. Pat. No. 2,684,450 issued in 1954 to E. L. Mager et al and in U.S. Pat. No. 2,838,715 issued in 1958 to E. C. Payne. The electrodes described in these patents are in the form of a pair of small-gage enameled wires wound on an insulating support and spaced apart at a short distance. The electroluminescent layer fills up the space between the wires.

U.S. Pat. No. 3,052,812 issued in 1962 to F. W. Dow discloses a flexible electroluminescent strand consisting essentially of a first copper wire of a predetermined diameter, a second copper wire of a smaller diameter coated with a high-dielectric material and wound around the first wire, and an electroluminescent phosphor coating applied to the surface of the first wire and engaging the surface of the dielectric coating of the second wire.

However, according to the method of manufacturing of the Dow's FLS described in the aforementioned patent, such an FLS is not suitable for production under industrial conditions. This is because the manufacture of the FLS requires the use of a special frame with hooks for guiding and passing the wires manually one by one.

U.S. Pat. No, 3,571,647 issued in 1971 to B. A. Robinson describes flexible electroluminescent structures made of a deformable electrically conductive material and a second electrode in the form of one or more insulated conductive wires connected to the surface of the deformable electrode. A layer of electroluminescent phosphor covers the conductors defining the second electrode and the exposed portions of the deformable electrode. The deformable electrode is on a substrate which may be rigid or flexible. When an AC voltage is applied across the electrodes, the phosphor layer luminesces with an intensity greatest in the vicinity of the second electrode.

Although this structure is more suitable for manufacturing under industrial conditions, it has the same disadvantages as all conventional flexible electroluminescent light sources, i.e., it does not allow one to control the core separately as a final semiproduct. Furthermore, it is not suitable for production in the form of a "travelling-light" structure and does not provide uniformity of luminescent properties in the longitudinal and transverse direction.

Russian Pat. No, 2,000,678 of 1993 to Ruben Polyan and Sergei Seryogin discloses a flexible electroluminescent light source with wire electrodes, wherein, in order to provide a linear light source, the electrodes (fibers) are positioned along the axis of symmetry, and the electroluminescent material in a dielectric binder fills up the space between the electrodes. Another Russian Pat. No. 2050042 of 1995 to Ruben Polyan and Sergei Seryogin discloses a method for manufacturing the aforementioned flexible electroluminescent light source, wherein a plurality of electrodes are drawn through a plastic mixture of an electroluminescent material with a dielectric binder. The mixture is compacted and fills up the spaces between the electrodes, with subsequent hardening of the dielectric binder and formation of a polymer sheath.

A disadvantage of the construction and manufacturing method described in the aforementioned two Russian Patents consists in that they do not allow a multisectional construction with individually controlled sections for implementation of an idea of "travelling light".

Thus, a disadvantage of all known flexible luminescent sources described above consists in that their electrodes (wires, insulated or non-insulated conductors, or conducting fibers) are either twisted, braided, or laid in parallel and that the electroluminescent material is either placed in the spaces between the electrodes or is applied to the electrode (electrodes). Most often, however, the electroluminescent material is applied to a flexible support to which the electrodes are attached. Since the surfaces of the electrodes are curved and because the layer of the electroluminescent material, which is located between the electrodes, has an intricate and variable-thickness configuration, an alternating electric field that causes the electroluminescent material to glow becomes substantially non-uniform. In the thinnest areas of the electroluminescent material, where the electric field is at its maximum, this material penetrates deeper into the interelectrode space and adjoins the electrodes. Therefore, glow of these zones makes an insignificant contribution to the overall light output of the light source. On the other hand, the working voltage U that has to assure the maximum brightness of glow of the FLS should be chosen to be as high as possible for effective excitation of the thick outer zones of the electroluminescent material in the binder (located close to the emitting surface) in the spaces between the electrodes, thus making the major contribution to the light output and determining the overall brightness of the FLS. This is not, however, possible, because the voltage U necessary for effective excitation of the relatively thick outer zones of the electroluminescent material in the binder will cause break down through the thinner inner zones of the electroluminescent material. For this reason, the working voltage $U_{br}$ has to be strictly limited on the outer side by the breakdown voltage $U_{br}$ of the thinner inner zones. Therefore, the thicker outer zones of the electroluminescent material will glow weaker than possible, and the light source will have low brightness. Limitation of U is also necessary because of the possibility of breakdown of insulation on the electrodes at points of their contact or at points were they extend close to each other.

Therefore, substantial non-uniformity of the electric luminescent material that fills in the spaces between the electrodes does not allow the maximum possible brightness of glow of the FLS to be achieved, with increased probability of breakdown through both the electroluminescent layer and insulation of the electrodes, thus lowering overall reliability of the light source and limiting the brightness.

Another disadvantage of all prior art constructions resides in that the electroluminescent layer that fills up the spaces between the electrodes could be formed either by applying a viscous liquid suspension (an electroluminescent material with a dielectric binder) to the electrode (electrodes) or to the substrate which supports the electrode, or by filling the spaces between the electrodes. After application of the suspension and removal of its surplus, the assembly is dried, and the electroluminescent layer is regarded as substantially formed after drying.

When the suspension is applied and its surplus is removed, the relief structure formed by the plurality of the electrodes (characteristic of the FLS structure) interacts with the suspension that behaves like an abrasive material. This interaction results in the electrode insulation being damaged (the emery paper effect), and the preset regular pattern of the electrode arrangement is disrupted. Similar consequences take place as a result of shrinkage of the electroluminescent suspension during drying when internal stresses develop within the body of the interelectrode electroluminescent layer. In addition, the suspension flows under gravity during drawing, whereby uniformity of the electroluminescent layer thicknesswise is disrupted. All these factors result in three-dimensional non-uniformity of the light output of the FLS, and hence in low brightness, brightness nonuniformity over the glow area, and low reliability that is caused by probability of short circuit through the damaged portions of insulation and the thinnest portions of the interelectrode electroluminescent areas. In addition, the use of viscous liquid suspensions results in cracks, bubbles, and voids appearing within the body of the electroluminescent layer after drying. These defects subsequently become the points of concentration of atmospheric moisture that causes accelerated degrading of the electroluminescent layer.

Still another disadvantage of conventional flexible luminescent sources consists in that the need to form an electroluminescent layer in the FLS by applying a viscous liquid suspension to the electrode (electrodes) or to the interelectrode spaces limits concentration of the electroluminescent material in the suspension on the upper side (with maximum not exceeding 2: 1). This, in turn, limits brightness of glow of the FLS that otherwise could be higher with greater concentration of the electroluminescent material.

Manufacture of the aforementioned FLS by a continuous method involves application of a pulling force of the drawing mechanism (in the transport direction during formation of the electroluminescent layer and the sheath) to the plurality of small-gage electrodes (that are normally made of copper due to its low resistance), i. e., lengthwise of the electrodes. The electrodes are thus put under tension, and their insulation may crack. The consequences of this are obvious: putting the electrodes under tension disrupts the regular pattern of their arrangement, thus resulting in non-uniform properties of the produced FLS and in non-uniform brightness over the glow area. Furthermore, eventual cracks in the insulation increase the chance of short-circuiting, thus lowering reliability of the light source.

All prior art constructions of the FLS essentially involve three-dimensional distribution of the electroluminescent material in the binder adjacent to the electrodes, and the thickness of the electroluminescent layer is comparable with the cross-sectional dimensions of the electrodes. As there are no reflecting layers in the construction, radiation originating within the body of the electroluminescent layer (the inner zones adjacent to the electrodes) does not practically reach the surface of the light source, thus lowering efficiency of the light source and brightness of its glow.

In all prior art constructions of the FLS, the glow color (red, yellow, green, blue) is determined by the type of the electroluminescent material used, whereby light sources with a greater variety of the glow colors cannot be obtained.

Moisture resistance that mainly determines life of the FLS depends to a great extent on properties of the thin polymeric sheath, which can prove insufficiently tight in a number of applications.

In all prior art constructions of the FLS the radiating surface (surfaces) glows equally (with one color or a set of different colors) over the entire glow area, thus limiting the possibility of providing light sources with a preset three-dimensional distribution of the glow colors in the glow area.

In all prior art constructions of the elongated FLS (glow filaments, conductors, strips), the breaking strength under tension or bending (except for those described in Russian Pat. No. 2000678 and in aforementioned article of Polyan and Seryogin) depends on the elastic properties and strength of the combination of the electrodes and sheath. According to Russian Pat. No. 2000678 and aforementioned article of Polyan and Seryogin, to assure a required arrangement of the electrodes and to enhance the breaking strength of the FLS, polymer threads are placed into the space between the electrodes, but the cross-sectional areas of the threads are still limited by the thickness of the electrodes. For this reason, the breaking strength of the FLS can prove inadequate, thus limiting the field of application of the light sources.

In all prior art constructions of the elongated FLS with glow filaments, conductors, and strips, high flexibility is assured, owing to flexibility of the system of the electrodes and sheath. For this reason, the FLS cannot be used in applications where the elongated light source has to be plastic (i. e., where it has to retain its shape after deformation) or rigid. This also limits the field of application of the elongated FLS.

In all prior art constructions of the elongated FLS, the power supply wires to which the working voltage U is applied are connected directly to the ends of the wire electrodes and, bearing in mind a small gage of these wires, the soldering points are in the zone most vulnerable to breaking forces. This lowers reliability of FLS.

Another disadvantage of known elongated FLS is that the damage or breakage of the electrodes will make the emitter inoperative over its entire length, thus lowering reliability of the FLS as a whole.

It should be noted that in all prior art constructions of the elongated FLS, it is not possible to turn on independently individual parts (sections) of FLS extending along, or transversally with respect to, the electrodes, since the prior art constructions involve energization of the FLS as an integral unit having a length equal to the length of the electrodes. This does not allow a damaged portion (section) of the FLS to be disconnected with the light source remaining in operation as a whole. This lowers reliability of the light source. In addition, glowing parts (sections) of the FLS extending in series along, or transversally with respect to, the electrodes cannot be switched, thus ruling out the possibility of providing dynamic light effects such as the "traveling light" effect. None of the existing FLS structures possesses moisture-resistant properties which are the main factor in protecting the luminescent layer from deterioration.

OBJECTS OF THE INVENTION

In view of the above, it is an object of the present invention to provide a construction and a continuous method for manufacturing an elongated electroluminescent light source (ELS) with electrodes extending along the longitudinal axis of the light source, which, unlike the prior art devices, has higher brightness, greater uniformity of glow over the area, higher reliability, longer life, greater strength, larger range of the glow colors, a preset three-dimensional distribution of the glow colors in the plane (planes) of glow, which has flexibility, plasticity or rigidity, which makes it possible to turn on or switch independently individual parts (sections) of the light source that extend along, or transversally with respect to the longitudinal axis, and which has a larger field of application owing to the above-mentioned properties.

Further objects and advantages of the present invention will become apparent after consideration of the ensuing description and drawings.

DRAWINGS

SUMMARY

An electroluminescent light (ELS) source that consists of a core member and a pair of transparent band structures between which the core member is sandwiched and which, in an assembled state of ELS, form a transparent sheath. The core is formed by a plurality of elongated electrodes spaced from each other and interconnected by means of connecting bodies of a dielectric material.

The entire system of electrodes is placed between a pair of electroconductive buses to which the electrodes are connected electrically and which support the system of electrodes through dielectric separating blocks. In order to provide dynamic light effects (e. g., "traveling light"), the electrodes may be combined into separate isolated groups arranged lengthwise or widthwise with electrical connection of each group to a respective electroconductive bus via a switching device. A method of manufacturing of the ELS of the invention consists of two stages: forming a core and transparent band structures in two separate but simultaneous processes, and assembling the premanufactured units by sandwiching the core between a pair of band structures. The electroluminescent material which has to be placed between the electrodes is applied onto mating surfaces of the band structures in the form of electroluminescent films. In the second stage of the process, when the band structures are pressed to each other under heating, the material of the electroluminescent films is forced into spaces between the electrodes.

DETAILED DESCRIPTION OF THE INVENTION

Figure 1:
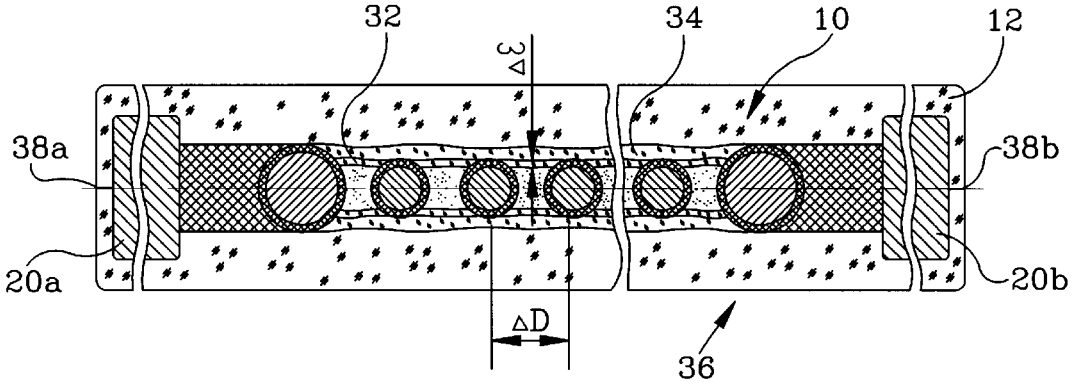
FIG. 1 is a cross-sectional view of an electroluminescent source of the present invention formed in a two-stage continuous manufacturing process by sandwiching a premanufactured core element between two mating band structures.

FIG. 1 is a cross-sectional view of an electroluminescent source (ELS) of the present invention formed in a continuous manufacturing process by sandwiching a core element between two mating band structures.

As can be seen from FIG. 1, the ELS consists mainly of three parts, i.e., an elongated core member 10 and two mating band structures 12 and 14 between which core member 10 is sandwiched. The structure of each of the aforementioned part will be further described separately in detail.

The manufacture of an ELS of the invention consists of two main stages: a first stage in which core member 10 and mating band structures 12 and 14 are produced in separate continuous processes, and a second stage in which the aforementioned core member is sandwiched between two mating band structures for assembling the premanufactured components into a final ELS.

In the subsequent description references will be made to the aforementioned first and second stages.

CONSTRUCTION OF CORE MEMBER

Figure 2:
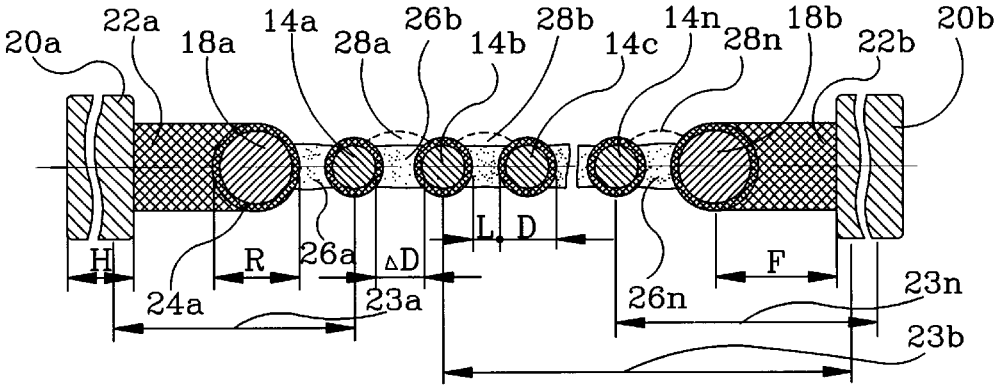
FIG. 2 is a transverse sectional view of a core member of the invention that consists of a plurality of thin electrodes in the form of conducting fibers or wires with insulation on the surface of the electrodes.

The design of core member 10 is shown in FIG. 2. It can be seen that core member 10 consists of a plurality of thin parallel electrodes 14*a*, 14*b*, . . . 14*n*, e.g., in the form of a group of parallel conducting fibers or wires, if necessary, with insulation 16 on the surface of each electrode, and elongated border bodies 18*a* and 18*b* on each side of the group of the electrodes. The electrodes have a longitudinal direction which is determined the longitudinal direction of the ELS itself. In the direction perpendicular to the longitudinal direction, i.e., in a transverse direction of the ELS, the electrodes are arranged in a row. A pair of conducting buses 20*a* and 20*b* which fulfill a function of a power supply source are located on both outer sides of elongated border bodies 18*a* and 18*b* and extend lengthwise in the direction parallel to electrodes 14*a*, 14*b*, . . . 14*n*. The electrodes are electrically connected to conducting busses 20*a* and 20*b* by means of lead wires 23*a*, 23*b*, . . . 23*n*. For example, all odd-numbered lead wires can be connected to conducting bus 20*a* and all even-numbered lead wires are connected to conducting bus 20*b*. Elongated border bodies 18*a* and 18*b* are attached to conducting buses 18*a* and 18*b* by means of separating dielectric blocks 22*a* and 22*b*.

Electrodes are connected to each other and outermost electrodes 14 and 14*a* are connected to border bodies 18*a* and 18*b* by means of respective connecting elements 26*a*, 26*b*, . . . 26*n*. In order to improve dielectric properties of the connecting elements and to turn them to "mirrors" for enhancing light output properties, the material of connecting elements 26*a*, 26*b*, . . . 26*n* may contain a dielectric light-reflecting substance such as titanium dioxide or barium titanate.

Elongated border bodies 18*a*, 18*b* and conducting buses 20*a*, 20*b* may be flexible, plastic, or rigid.

Conductive fibers or wires may be made of copper or any other suitable highly conductive material. Elongated border bodies 18*a* and 18*b* may be made of dielectric materials and/or a conducting materials and their surfaces may be insulated by means of insulation layers 24*a* and 24*b*, respectively.

It should be noted that electrodes 14*a*, 14*b*, . . . 14*n*, border bodies 18*a* and 18*b*, as well as conducting buses 20*a* and 20*b* (hereinafter referred to as members 14, 18, and 20) may be arranged in the aforementioned transverse direction in a predetermined regular pattern, i.e., they are spaced from each other and from a certain longitudinal axis at predetermined distances.

In the most simple case, the longitudinal axis is a straight line extending in a plane, and members 14, 18, and 20 lay in the aforementioned plane in parallel with each other along the aforementioned longitudinal axis and symmetrically with respect thereto.

Free spaces 28*a*, 28*b*, . . . 28*n* remain between adjacent electrodes 14*a*, 14*b*. . . 14*n* as well as between outermost electrodes 14*a* and 14*n* and elongated border bodies 18*a* and 18*b*. The cross-sectional configuration of these free spaces is close to a rectangular configuration. The cross-sectional dimension D of each of electrodes in the aforementioned transverse direction as well as the minimum distance L between the electrodes are in a predetermined relationship with an average size Δx of the grain of the electroluminescent material, which will be described later and which is used in the construction of the electroluminescent light source of the present invention. This relationship is the following:

$$D \gg \Delta x;\ L > \Delta x.$$

As has been mentioned above, elongated border bodies 18*a* and 18*b* are attached by means of dielectric separating blocks 22*a*, 22*b* to conducting buses 20*a* and 20*b*. Dielectric or conducting elongated border bodies 18*a*, 18*b* are used, in particular, for separating the plurality of electrodes 14*a*, 14*b*, . . . 14*n* and conducting buses 20*a* and 20*b*. In addition, elongated border bodies 18*a*, 18*b* and conducting buses 20*a* and 20*b* are used for realization of multiple-group ELS having components (sections) extending along, or transversally with respect to, the longitudinal axis of the light source. In addition, members 18*a*, 18*b* and 20*a*, 20*b* enhance the breaking strength.

The cross-sectional dimension R of elongated border bodies 18*a* and 18*b* and the cross-sectional dimension H of conducting buses 20*a* and 20*b* are related to the cross-sectional parameters D of electrodes 14*a*, 14*b*, . . . 14*n* as follows: R>D; H>>D. The linear cross-sectional dimensions ΔD of free spaces 28*a*, 28*b*, . . . 28*n* meet the condition ΔD>Δx. The linear cross-sectional dimensions F of dielectric separating blocks 22*a*, 22*b* are chosen so that F>H.

Connection of a plurality of electrodes 14*a*, 14*b*, . . . 14*c*, elongated border bodies 18*a*, 18*b*, and conducting buses 20*a*, 20*b* by means of connecting bodies 26*a*, 26*b*, . . . 26*n* and dielectric separating blocks 22*a*, 22*b* allows members 14, 18, and 20 of core member 10 to be positioned in a preset manner along the longitudinal axis and, which is important, makes it possible to fix electrodes 14*a*, 14*b*, . . . 14*n* by means of connecting bodies 26*a*, 26*b*, . . . 26*n* in a desired position and retain their spacing by filling up the spaces at points where electrodes 14*a*, 14*b*, . . . 14*n* come close to each other. This minimizes scattering of the electric field intensity in the spaces between the electrodes, assures that the electric fields in free spaces 28*a*, 28*b*, . . . 28*n* are close to a uniform field, and provides for uniform distribution of the electric field lengthwise and widthwise of core member 10. The dielectric material of connecting bodies 26*a*, 26*b*, . . . 26*n*, which separates and connects together electrodes 14*a*, 14*b*, . . . 14*n* minimizes the possibility of electric breakdown at points of the maximum concentration of the electric field, i. e., in locations where the distance between the electrode surfaces is at minimum. This improves reliability.

Dielectric separating blocks 22*a*, 22*b* which connect conducting buses 20*a*, 20*b* to elongated border bodies 18*a*, 18*b* impart strength to core member 10 and may have the moisture-absorbing properties.

The moisture-absorbing properties of dielectric blocks 22*a*, 22*b* (e. g., of a transparent nylon-6 thermoplastic produced by Allied Chemical Corp. under trademark "Capran" or magnesium perchlorate) allow life of the ELS to be extended. In addition, the spaces between conducting buses 20*a*, 20*b* and elongated border bodies 18*a*, 18*b* may be used for receiving fastener members (dowels, brackets, etc.) (not shown).

Electrodes are connected, e.g., at the end of the ELS, to conducting buses 20*a*, 20*b* which are used for supplying current to electrodes 14*a*, 14*b*, . . . 14*n* at the end of the ELS or to each group of electrodes. Power supply leads from a power source (not shown) are also connected to conducting buses 20*a*, 20*b*. The use of conducting buses 20*a*, 20*b* for connection of electrodes, e.g., by soldering of electrodes and for connecting them to the power supply source improves reliability of the ELS. In addition, with the continuous process of manufacture of core member 10, the pulling force of drawing is applied to relatively thick and less vulnerable conducting buses and/or to elongated border bodies 18*a*, 18*b*, rather than to the plurality of thin electrodes 14*a*,

14*b*, . . . 14*n*. This allows tensioning of the electrodes to be avoided during drawing, whereby their regular pattern is not disrupted, and breakage of electrodes 14*a*, 14*b*, . . .14*n* and cracks in their insulation 16 are eliminated. All this allows uniformity of distribution of the electric field between the electrodes to be improved and reliability to be enhanced.

Thus, it has been shown that by using, in the aforementioned first stage, an independent process for manufacturing core 10, a system of electrodes arranged in a predetermined pattern along the longitudinal axis is formed. In addition to the system of electrodes, the core of the electroluminescent source of the invention is provided with elongated border bodies 18*a*, 18*b* and conducting buses 20*a*, 20*b* which are arranged in such a manner that electrodes 14*a*, 14*b*, . . . 14*n* are separated and connected together and the outermost electrodes are connected to elongated border bodies 18*a*, 18*b* by connecting bodies 26*a*, 26*b*, . . . 26*n*. Elongated border bodies 18*a*, 18*b* are connected to dielectric blocks 22*a*, 22*b* with moisture-absorbing properties. The linear cross-sectional dimensions of electrodes 14*a*, 14*b*, . . . 14*n*, free spaces 28*a*, 28*b*, . . . 28*n* between the electrodes, elongated border bodies 18*a*, 18*b*, and conducting buses 20*a*, 20*b* are greater than the characteristic grain size of the electroluminescent material, and the electric field in free spaces 10 being close to the uniform field as much as possible. This allows the electric field to be uniform lengthwise and widthwise of core member 10 in the interelectrode space, whereby brightness is increased and is uniformly distributed over the glow area of the ELS; light output is increased, reliability and strength are enhanced, life is extended; and multiplegroup ELS can be realized.

Core member 10 may be produced in the first stage by drawing electrodes 14, border bodies 18*a*, 18*b*, and conducting buses 20*a* and 20*b*, e. g., through the melt of the material of connecting bodies 26*a*, 26*b*, . . . 26*n* and through the melt of the material of dielectric separating blocks 20*a* and 20*b*.

Core member 10 made by using an independent manufacturing process is a component part of the ELS on the one hand, and a finished intermediate product, on the other hand. This allows intermediate quality control and rejection of the core member to be carried out during manufacture of the ELS. This is another contribution to an increase of the production of high-quality ELSs.

LAYERED BAND STRUCTURES

As mentioned above, a pair of layered band structures 12 and 14 are manufactured in the first stage simultaneously with the manufacture of core member 10 in an independent continuous manufacturing process.

Figure 3:
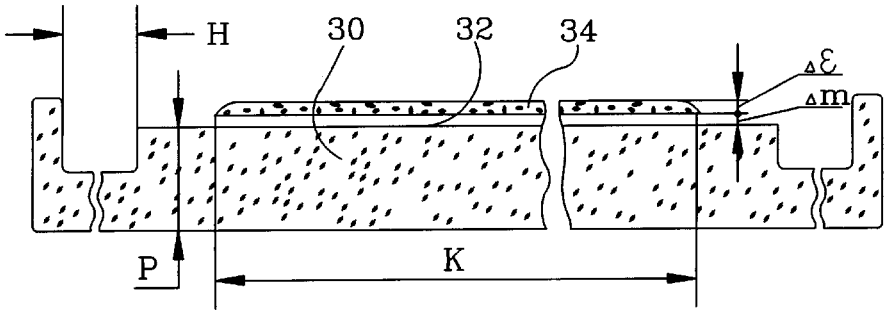
FIG. 3 is a transverse sectional view of a layered band structure for the core element of FIG. 1.

FIG. 3 shows a design of layered band structures 12 and 14. Since both layered band structures 12 and 14 are identical, only one of them, e.g., layered band structure 12, will be described. Layered band structure 12 is made in the form of a transparent (in the visible area of the spectrum) polymer support 30 having an inner surface (AB) to which an auxiliary transparent film layer or layers 32 and an electroluminescent film layer 34 are consecutively applied. The transverse width K of these layers corresponds to the distance between elongated border bodies 18*a* and 18*b* of core member 10. Relief on the inner surfaces of the band structures formed by layers 32 and 34 allow the electrodes of core member 10 to be accurately placed between the band structures with accuracy on the order of the thickness of the electroluminescent layer.

The thickness Ae of electroluminescent film layer 34 and the thickness Am of auxiliary film layer or layers 32 are determined in relation to the size $\Delta x$ of the electroluminescent material grain as follows: $\Delta e > \Delta x$; $\Delta m > \Delta x$, with $\Delta e < D$. Thickness P of the polymer support (without layers 32 and 34) should be much greater than the thickness of the largest component of the core member in the transverse of the ELS, i.e., it should be thicker than conducting buses 20*a* and 20*b*. Combined film layers 32 and 34 should project over the surface AB in such a manner that their overall thickness is close to the distance from the surface of the connecting bodies to the surfaces of dielectric separating blocks 22*a* and 22*b*, and the position of the last-mentioned surfaces is determined, in turn, by a linear dimension R of elongated border bodies 18*a*, 18*b*.

Polymer support 30 may be made, e.g., of polyethylene, thermoelastoplasts, fluorohalocarbons such as fluorocarbon produced by Allied Chemical Corporation under trademark "Aclar", polyvinyl chloride, polyamide, or the like. These materials are chosen because they meet the requirements of high light transmissivity in the visible spectral area, high breakdown voltage value, tightness, and good adhesion to the materials of auxiliary film layer 32 and/or electroluminescent film layer 34. Impurities can be added to the material of polymer support 30, or optical defects can be caused in the material of polymer support 30 in order to increase the glowing surface area of the ELS. Dye centers can be added to the polymer support (e. g., of an organic dye) to obtain a broader spectrum of glow of the ELS, which is not limited to the glow colors of conventional luminophors, as is the case with a colorless sheath.

Auxiliary film layer 32 may be made of a transparent moisture-absorbing material (such as a transparent nylon-6 thermoplastic produced by Allied Chemical Corp. under trademark "Capran") to slow down the degrading processes in electroluminescent film layer 34 and to assure extended life of the ELS. A photoluminophor can be added to auxiliary film layer 32 or applied to its surface. In this case, glow of electroluminescent film layer 34 will impart to auxiliary film layer 32 properties of photo excitation. As a result, the ELS will glow with a light the color of which is determined by combined properties of film layers 32 and 34 (e. g., if blue electroluminescent material 34 is used and yellow photoluminophor 32 is used, the glow light of the ELS will be close to white). This allows a broader spectrum of glow light colors of the ELS to be obtained. Auxiliary film layer 32 can be formed on the surface AB, e. g., by casting or by spraying, with the requirements of good adhesion at interfaces 30–32 and 32–34.

Electroluminescent film layer 34 based on a dielectric binder having thermoplastic properties is formed on the surface of auxiliary film layer 32, e. g., by casting or by spraying, with the requirement of good adhesion at interface 32–34. Electroluminescent film layer 34 is very uniform thicknesswise. It has a relatively high concentration of the electroluminescent material (up to 5:1), ensures a desired distribution of the electroluminescent materials lengthwise and widthwise, and during forming demonstrates thermoplastic properties required for subsequent integration of the electroluminescent film layer into free interelectrode spaces 28*a*, 28*b*, . . . 28*n* of core member 10. This assures uniform glow of the ELS over the area, enhances brightness, assures the desired distribution of the glow color over the area. The glow areas of the ELS may have different colors (color distribution) over the entire glow area or over a part thereof.

Therefore, by using the laminated band structures with the sequentially arranged layers of an electroluminescent material 34, an auxiliary film layer 32, and a polymer support 30 with properties of the layers described above, an ELS with uniform glow over the luminescent area can be obtained, with enhanced brightness, broader spectrum of the glow colors, and control of the glow color lengthwise and widthwise of the ELS. The glow surface area of the ELS is as large as polymer sheath formed by the material of polymer support 30.

Similar to core 10, layered band structures 12 and 14 obtained as a result of the continuous manufacturing process are components of the ELS, on one hand, and are finished intermediate products, on the other hand. This circumstance allows intermediate quality control and rejection of the improper band structure, thus enhancing reliability of the ELS and raising yield of normal-grade products.

Although two layer band structures 12 and 14 described above were identical in their shape and dimensions, it is understood that they may be different.

At a second stage of a continuous manufacturing process, the two main structural components of the ELS, i.e., core member 10 and two layered band structures 12 and 14 are combined (e. g., by thermal compression). The combining process is carried out in such a manner that the structure of the finished product is in the form of a sandwich in which core member 10 is fixed between two band structures. Both polymer supports 30 of the band structures form an integral polymer sheath 36, and film layers 34 and 32 projecting over the surface AB are displaced in such a manner that electroluminescent film layer 34 is forced into free spaces 28*a*, 28*b*, . . . 28*n* between electrodes 14*a*, 14*b*, . . . 14*n* and between the outermost electrodes and elongated border bodies to fill them up, with auxiliary film layer 32 extending over this layer and filling up the zone over the electrodes, as well as between the outermost electrodes and elongated border bodies 18*a* and 18*b*, as shown in FIG. 1.

Therefore, when core member 10 and band structures 12 and 14 are combined under pressure and heating, electroluminescent film layer 34 having thermoplastic properties is divided into the longitudinally extending film strips 34*a* of electroluminescent layer 34 and a continuous auxiliary film layer 32 which extends longitudinally and transversely over the surface of the electrode system.

More specifically, the material of layers is forced into free spaces 28*a*, 28*b*, . . . 28*n* between the electrodes and between the outermost electrodes and elongated border bodies 18*a* and 18*b*, respectively, to fill up these spaces. On the other hand, auxiliary film layer 32 covers the projecting portions of the electrodes as well as the luminescent strips 34*a* which in this case are brought closer to electrodes and fills deep spaces between the electrodes.

Air and surplus materials of electroluminescent film layer 34 and auxiliary film layer 32 are squeezed out during the combining process in the direction toward conducting buses 20*a* and 20*b* toward side seams 38*a* and 38*b* of polymer sheath 36. Moisture released during this process is absorbed by the material of dielectric separating blocks 22*a* and 22*b* and, in certain embodiments, by auxiliary film layer 32.

It should be noted that, by virtue of the properties of the core member and band structures, both the desired position of members 14*a*, 14*b*, . . . 14*n*, 18*a*, 18*b*, and 20*a*, 20*b* of core member 10 and topology of film layers 34 and 32 relative to each polymer support 30 of respective band structures are not disrupted during the combining process.

As has been mentioned above, the resulting longitudinally extending film strips of electroluminescent layer 34 that fill up free spaces 28*a*, 28*b*, . . . 28*n* have longitudinal configurations that follow the configuration of the interelectrode spaces. Since the cross-sectional configuration of such film strips is close enough to the rectangular configuration ($\Delta e<D$), the electric field in these areas that appears upon application of the voltage U to electrodes 14*a*, 14*b*, . . . 14*n* is substantially uniform. This allows the working voltage U to be brought to a subbreakdown value ($U<U_{br}$) so as to assure the maximum possible glow brightness. As the thickness of the electroluminescent film layer $\Delta e$ changes lengthwise and widthwise of the longitudinally extending film areas only insignificantly, ELS glow is very uniform in space.

Because the electrodes are continuous, the applications of voltage U to electrodes 14*a*, 14*b*, . . . 14*n* of the ELS causes glow of the light source over the entire width and length of the source.

In some cases, however, it may be necessary to control glow of parts (sections) of the ELS extending lengthwise or transversely of the light source, so that glow of the sections can be switched to provide dynamic light effects (e. g., "traveling light") within the ELS.

Figure 4:
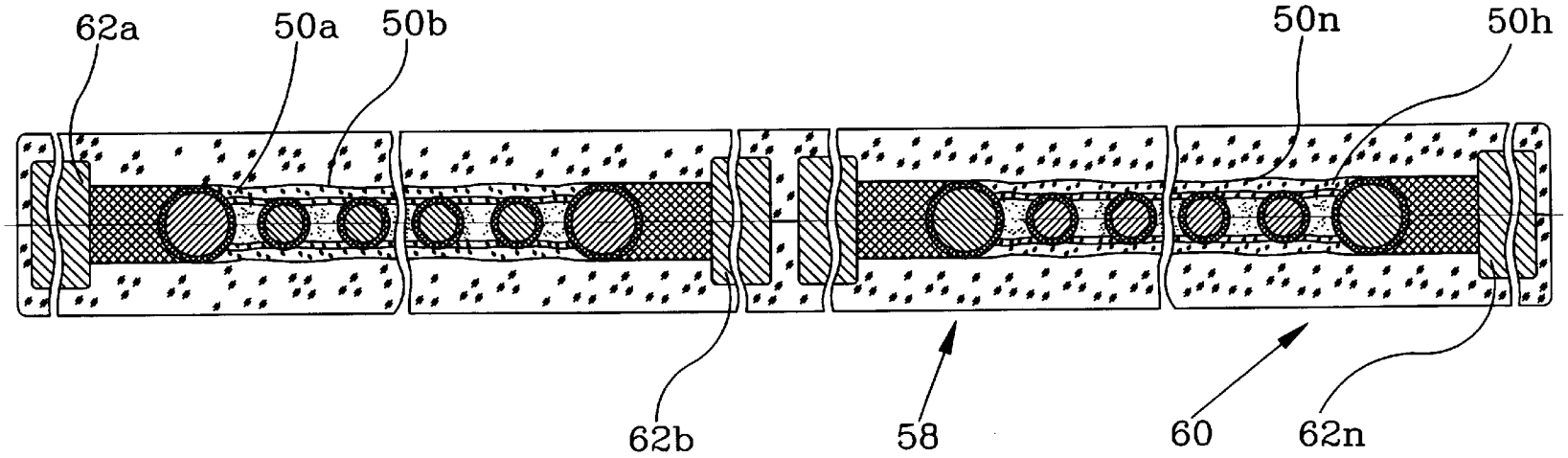
FIG. 4 is a fragmental transverse sectional view of ELS with individually controlled multiple-layered multiple groups of electrodes arranged in a transverse direction.

To obtain an ELS having sections extending widthwise, i. e., transversely with respect to the longitudinal axis of the light sources, the core member may have a periodically repeating pattern of FIG. 1 with electrodes extending widthwise. As shown in FIG. 4, in this case the band structure will be in the form of a polymer support having a periodically repeating pattern of film layers 50*a*, 50*b*, . . . 50*n*, extending widthwise, which are laid onto polymer supports 52 and 54 of the type shown in FIG. 3. When such a core structure and band structures are combined, a multiple-layer, multiple-group ELS of the type shown in FIG. 4 can be obtained. FIG. 4 is a transverse sectional view of ELS with individually controlled sections of the core. Although three such multiple-layer groups 56, 58, and 60 are shown in FIG. 4, it is understood that their number may be greater than three. Each section can be controlled independently by switching even and odd numbered sections of the electrodes to respective conducting buses 62*a*, 62*b*, . . . 62*n*. Switching can be carried out by means of standard switching equipment, which is beyond the scope of the present invention.

Figure 5:
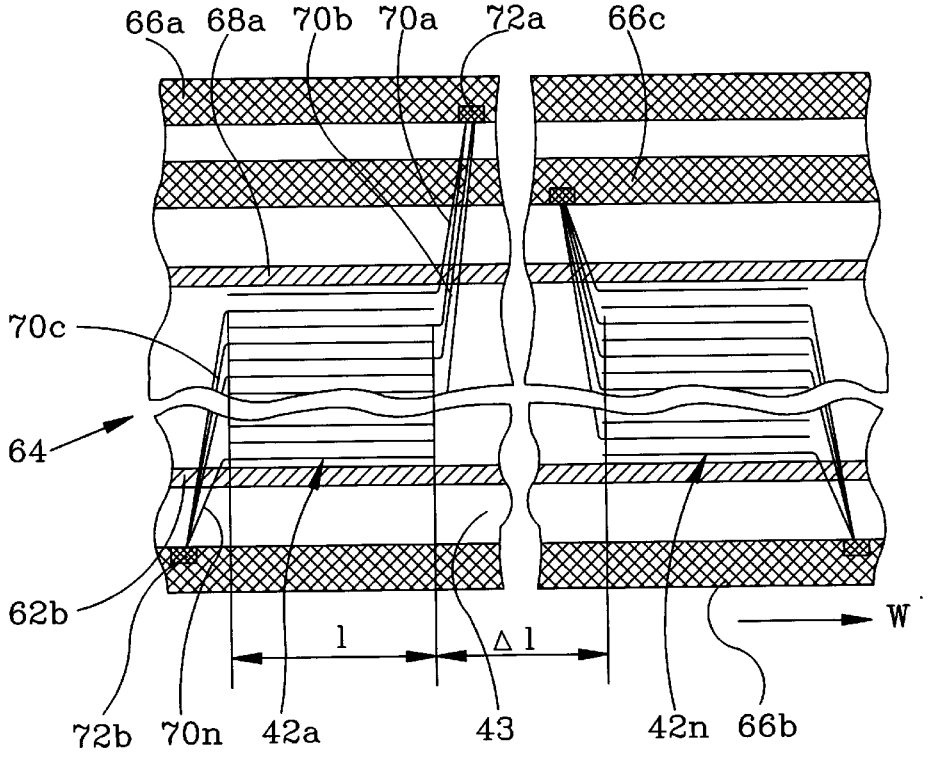
FIG. 5 is a fragmental longitudinal sectional view of an ELS with a multiplelayered groups of electrodes arranged in the longitudinal direction of the ELS.

To obtain an ELS sectioned lengthwise, i. e., along the longitudinal axis of the light source, the core member should be as shown in FIG. 5. This core member, which in general is designated as 64 differs from that shown in FIG. 1 by the fact that in a longitudinal direction the core consists of a group of electrodes 42*a*, 42*b*, . . . 42*n* and spaces 43 without electrodes. Groups of electrodes and electrode-free spaces are arranged in an alternating manner. In FIG. 5, the length of the electrode group is designated "l" and the length of electrode-free space is designated $\Delta l$ with the following condition being observed: $l>\Delta l$. FIG. 5 shows an embodiment with three conducting buses.

Each core member in the intervals "l" does not differ from what was described with reference to FIG. 2. However, in the intervals $\Delta l$, there is no electrical connection between the electrodes or between the electrodes and elongated border bodies 68*a* and 68*b*. Absence of connecting bodies in the intervals $\Delta l$ is ensured during manufacture of the core member, e. g., during drawing of the core member components through melts of the material of the connecting bodies and of the dielectric separating material by intermittently suspending supply of material of blocks 22*a* and 22*b* and of connecting bodies 26*a*, 26*b*, . . . 26*n* to working spaces of the drawing apparatus.

Electrodes 42*a*, 42*b*, . . . 42*n* are cut in the intervals $\Delta l$ in such a manner that the ends of the even-numbered electrodes can be tied together and connected to one conducting bus and the ends of the odd-numbered electrodes can be tied together and connected to another conducting bus. For example, as shown in FIG. 5, ends of electrodes 70*a*, 70*c*, . . . 70*n* are connected to conducting bus 66*a*, and the ends of electrodes 70*b* 70*d*, . . . 70(n−1) are connected to conducting bus 66*b*.

The process of connection of the ends of the even-numbered and odd-numbered electrodes to different conducting buses is carried out by positioning the cut even-numbered and odd-numbered electrodes in the interval Δl in two parallel planes extending in parallel with the plane of the core member and spaced from each other at a distance of about D. The ends of the evennumbered and odd-numbered electrodes are soldered, in a continuous manufacturing process of making the core member, to contact tabs 72*a* and 72*b* of respective conducting buses 66*a* and 66*b*.

In this embodiment, the band structure is similar to the structure shown in FIG. 3, but differs by the fact that film layers 4 and 5 are also applied to form a regular pattern and define areas of the length "l" lengthwise of the band structure, no film layers being provided in the intervals Δl between these areas. Instead of film layers 4 and 5 projecting over the surface AB of polymer support 9, the material of polymer support 9 projects in the intervals Δl.

The process of combining the core member and band structures is carried out as described above, but with the additional proviso: the areas of these components with the length "l" and the intervals Δl between them should be matched during the combining process.

In the most simple case where the core member has three conducting buses 66*a*, 66*b*, and 66*c*, the electrodes of the odd-numbered consecutive sections are connected to conducting buses 66*a* (e. g., odd-numbered) and 66*b* (even-numbered). The electrodes of the even-numbered consecutive sections are connected to conducting buses 66*c* (e. g., odd-numbered) and 66*b* (even-numbered).

When the voltage U is applied to conducting buses 66*a* and 66*b*, all odd-numbered sections will glow, and when the voltage is applied to buses 66*c* and 66*b*, the even-numbered sections will glow. Alternating application of the voltage U to conducting buses 66*a*, 66*b* and 66*c*, 66*b* will implement the simplest switching mode assuring the dynamic effect of the "traveling light" type.

The construction of the multiple-group core member shown in FIG. 5 with independently controlled groups of electrodes assures operability of the ELS if one or several groups fail, thus enhancing reliability of the ELS.

This construction of the multiple-group core member is convenient for cutting the elongated ELS of a large length into parts, the cutting line extending perpendicularly to electrodes 70*a*, 70*b*, . . . 70*n* within the interval Δl. If only one section is cut out, a simple ELS is obtained as a single ELS of the type shown in FIG. 1.

Figure 6:
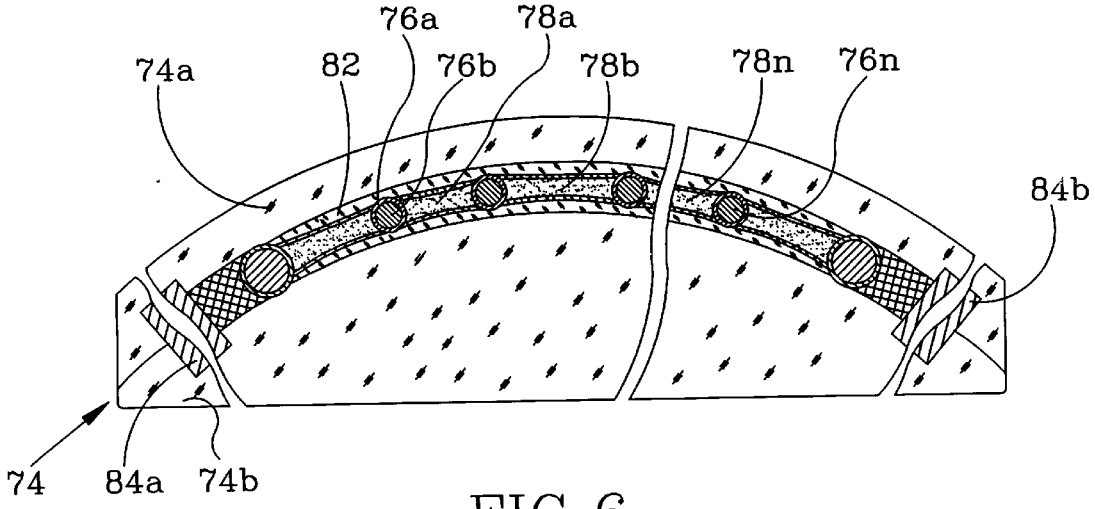
FIG. 6 shows an embodiment of the ELS with an arc-shaped line connecting the electrodes.

FIG. 6 shows an embodiment of the ELS that differs from the embodiment shown in FIG. 1 by the fact that parts of a polymer sheath 74*a* and 74*b* extending on either side of the system of electrodes 76*a*, 76*b*, . . . 76*n* interconnected by means of connecting bodies 78*a*, 78*b*, . . . 78*n* are of different cross-sectional configurations, with the line connecting the centers of gravity of the cross-sections of the electrodes being in a curved surface, e.g., is arc-shaped. In this embodiment, conducting buses are designated by reference numerals 84*a* and 84*b*. It is not necessary in this case to have the longitudinally extending film areas of electroluminescent layer 80 and auxiliary film layer or layers 82 on both sides of the electrode system. This "asymmetrical" ELS with an irregular intricately shaped cross-section of polymer sheath 74, in which the centers of gravity of the electrode cross-sections are in a smooth curved line, assures visibility of the glow area (areas) of the ELS within a broader range of angles. It should be noted that the embodiment of the "asymmetrical" ELS shown in FIG. 6 can be of the multiple-group design.

In all embodiments described above, the power supply leads (not shown) for application of the voltage U are connected (by soldering or welding) to the contact tabs of conducting buses.

OPERATION

In the description of operation, reference will be made mainly to electrodes, conducting busses, connecting elements, separating dielectric blocks, etc. of the embodiment of FIGS. 1 through 3. It is understood, however, that the description is equally applicable to operation of ELS of other embodiments in which some identical details of ELS are not shown.

All above-described ELSs function in the following manner. Δl ternating voltage U is supplied to conducting buses 20*a* and 20*b* (FIG. 1), 66*a*, 66*b*, and 66*c* (FIG. 5) or 84*a* and 84*b* (FIG. 6) to generate an alternating electric field in the interelectrode spaces, in which the longitudinally extending film areas of each electroluminescent layer 34 are located. The aforementioned alternating electric field causes the electroluminescent layer to glow according to the known mechanisms of electroluminescence. The color (colors) of glow of the ELS depends on the grade of the electroluminescent material used, a desired distribution of the electroluminescent materials of different grades within the plane of electroluminescent layer 34, photoluminescent and/or coloring properties of auxiliary film layer or layers 32, and optical (in particular, coloring) properties of polymer support 30 used to form polymer sheath 36.

PRACTICAL EXAMPLES

In an embodiment of concrete practical realization of the electroluminescent light source of the invention, having the construction shown in FIG. 1, the light source had the core member with the system of electrodes 14*a*, 14*b*, . . . 14*n* in the form of twenty two enameled copper conductors 0.25 mm in diameter spaced at 0.15 mm from each other. The core member was symmetrical with respect to the longitudinal axis extending through its central portion, between the eleventh and twelfth electrodes. Elongated border bodies 18*a*, 18*b* were in the form of insulated copper wires 0.35 mm in diameter, and conducting buses 20*a*, 20*b* were made of foil strips 3 mm wide and 0.5 mm thick. The distance from the central portion of conducting body 18*a* or 18*b* to the nearest edge of conducting bus 20*a* or 20*b*, respectively, was 6 mm. The minimum distance from elongated border body 18*a* to the nearest outermost electrode was 0.3 mm.

The thickness of connecting bodies 26*b*, 26*c*, . . . 26*n* was 120 μm, and the connecting bodies and dielectric separating blocks 822*a*, 22*b* were based on a dielectric composite mixture.

The band structure was formed on flexible transparent polymer support 30 and had the cross-sectional configuration shown in FIG. 2, with the width of 30 mm and the thickness of 2 mm. The inner surface of polymer support 30 was consecutively provided with: auxiliary photoluminescence film layer 32 that was 50 μm thick and with electroluminescent film layer 34 that was 60 μm thick. The width of these layers corresponded to the distance between elongated border bodies 18*a*, 18*b* and was about 15 mm.

After combining the core member and the band structures, a sample ELS was produced in the form of a band 20 m long, 30 mm wide, and about 4 mm thick.

The ends of the electrodes on one side of the sample were soldered alternately to two different conducting buses, and the other side of the sample was cut off and insulated with a sealant. Power supply leads were soldered to the ends of the conducting buses and connected to a sine voltage generator with an output voltage amplitude of 450 to 500 V at a frequency of 2 to 20 kHz. Brightness of glow of the ELS was recorded by means of a photometer.

Concrete embodiment of the method of manufacturing of an electroluminescent light source according to the invention will now be described.

In a specific embodiment of the method of manufacturing of an ELS, a symmetrical core member was made by simultaneously drawing electrodes 14*a*, 14*b*, . . . 1.4*n*, elongated border bodies 18*a*, 18*b*, and conducting buses 20*a*, 20*b* through a dielectric composite mixture that was used as the base for connecting bodies 26*a*, 26*b*, . . . 26*n* and dielectric separating blocks 22*a*, 22*b*. The working space of the drawing apparatus was in the form of three isolated chambers (not shown) that did not communicate with each other during drawing: a central chamber and two additional chambers positioned symmetrically on either side of the central chamber. Electrodes 14*a*, 14*b*, . . . 14*n* and elongated border bodies 18*a*, 18*b* (partly) were drawn through the central chamber, and the border bodies were drawn in such a manner that only one side surface of elongated bodies 18*a*, 18*b* facing towards the electrodes moved through the central chamber. The other side of elongated border bodies 18*a*, 18*b* facing toward the conducting bus were moved through additional chambers through which conducting buses 20*a*, 20*b* were moved during drawing. Only the edges of the buses facing toward elongated border bodies 18*a*, 18*b* were received in the additional chamber. All three chambers were filled with a viscous dielectric composite mixture. To form connecting bodies 26*a*, 26*b*, . . . 26*n* with the light-reflecting properties, a powder of barium titanate was added to the central chamber. To form dielectric separating blocks 22*a*, 22*b* having moisture-absorbing properties, magnesium perchlorate was added to the lateral chambers. The composite mixture based on ED-20 epoxy resin contained a plasticizer (dibutylphthalate), a hardener (polyethylene-polyamide), and an alcohol/acetone solvent. At the final stage of drawing, the core member was dried by causing it to pass through a drying chamber at 60° to 120° C., in which the material of connecting bodies 26*a*, 26*b*, . . . 26*n* and dielectric separating blocks 22*a*, 22*b* were cured.

The band structure was formed on flexible polymer support 30, e. g., of polyvinyl chloride or sevilene, by extrusion, and auxiliary film layer 32 and electroluminescent film layer 34 were formed by casting. In this particular case, photoluminescent film layer 5 was formed of low-density polyethylene at the melting point and contained FV-540-1 photoluminophor in the ratio of 1.5:1. Electroluminescent film layer 34 was formed on the basis of DST thermoelastoplast [elastomer] with a solvent (such as petroleum solvent) and a sieved (20 $\mu$m average grain size) commercial electroluminescent material of the grades: ELS455 (blue), EM-510 (green), and EM670 (red). After evaporation of the solvent under infrared drying, the ratio of the electroluminescent material to the binder in electroluminescent film layer 34 was at least 2.5:1.

Transparent polymer support 30 was colored during forming by adding pigments: golden yellow, phthalocyanide green and blue, or rhodamine.

The core member and band structures were combined into a finished structure of the ELS under pressure and heating by rolling in the nip or rolls. The process temperature, pressure and rolling speed assured "sintering" of polymer supports of the band structures to each other along the sides of the ELS and complied with the conditions required for the electroluminescent film layer having thermoplastic properties to be forced into the interlectrode spaces.

Specifications of the ELS in the aforementioned concrete practical embodiment were the following:

Glow color-all colors of the visible spectrum, including white;

Power supply through an adapter—220 V mains or a storage battery;

Brightness (for green color)—40 cd/m$^2$;

Power input—1.5 Wt/m;

Life (brightness half-life)—1200 hr;

Turn-on time—100 $\mu$s;

Turn-off time—100 $\mu$s without afterglow and hours with afterglow;

Width of the ELS—30 mm with 4 mm thickness;

Weight per unit area—0.6 g/cm$^2$;

Admissible bending radius—5 mm;

Breaking force—150 N

Operating temperature range—−35° C.−+35° C.;

Admissible relative humidity—80% to 100%;

Shelf life (under normal conditions)—2 years.

Thus, it has been shown that the present invention provides an elongated electroluminescent light source (ELS) which, as compared to conventional ELSs, has high brightness, greater uniformity of glow over the area, higher reliability, longer life, greater strength, larger range of the glow colors, a preset threedimensional distribution of the glow colors in the plane (planes) of glow, higher flexibility, plasticity or rigidity, and which makes it possible to turn on or switch independently individual parts (sections) of the light source that extend along, or transversally with respect to the longitudinal axis, and which has a larger field of application owing to the above-mentioned properties. The invention also provides a method for manufacturing aforementioned ELS in a continuous process with possibility of checking the quality of elements of the ELS at separate manufacturing stages.

Although the invention has been shown and described with reference to specific examples, it is understood that these examples do not limit the scope of the invention, and that any other modifications and changes are possible, provided they do not depart from the scope of the appended claims. For example, although only three groups of electrodes have been shown in the embodiment with a multiple-layer, multiple-group ELS, the number of groups of the electrodes may be greater than two. The surface of the ELS is not limited to flat and arc-shaped configuration and may be of any desired profile. The electrodes may have a rectangular rather than circular configuration. The band structures between which the electrodes are sandwiched are not necessarily identical and symmetrical in their shape and dimensions. The electrodes themselves may have different dimensions and cross-sectional configurations and may be arranged at irregular intervals.

I claim:

1. An electroluminescent light source having a longitudinal axis and comprising:

a core member including:

a system of electrodes extending along said longitudinal axis in form of a row of parallel stripes, each of said electrodes having a thickness in a direction perpendicular to said longitudinal axis, said system of electrodes having on both sides outermost electrodes;

electrical insulating connecting bodies located between said electrodes, said connecting bodies connecting adjacent electrodes to each other, said electrodes being located at predetermined distances from each other, said connecting bodies being composed of a dielectric material in form of strips having a thickness that is smaller than said thickness of any of said electrodes; and a layer of at least one powdered electroluminescent material dispersed in a dielectric binder and located between said electrodes, said layer of said electroluminescent material being composed of film strips extending in said longitudinal direction and located between said electrodes immediately above said connecting bodies at least on one side thereof;

at least two current conducting busses connectable to a power supply source and electrically connected to said electrodes for supplying a current to said electrodes; and an insulating transparent polymer sheath having an inner surface covering said core member and said current conducting busses by bringing said inner surface into pressure contact with said core member;

said current conducting busses being connected to said outermost electrodes through dielectric separating blocks;

said layer of said electroluminescent material being applied to said inner surface and being formed into said strips during said pressure contact.

2. The light source of claim 1, further comprising an elongated border body composed of an electric material and provided on each side of said system of said electrodes between a respective current conductive bus and a respective outermost electrode of said system and auxiliary connecting bodies which connect said elongated border bodies to said respective electrodes with an auxiliary film of an electroluminescent material extending in said longitudinal direction above a surface and at least on one side of said auxiliary connecting bodies.

3. The light source of claim 2, wherein the following conditions are observed:

: $D \gg \Delta x$, $L > \Delta x$, $\Delta D > \Delta x$, with $R > D$, $H \gg D$, and $F \geqq H$, where D is a thickness of said electrodes in a direction perpendicular to said longitudinal axis, $\Delta D$ is a thickness of said electroluminescent layer, H is a width of said conducting busses in a direction of said row; R is a width of said elongated border bodies in the direction of said row, F is a distance from centers of said dielectric separating blocks to a respective current conducting bus, L is a distance between said electrodes; and $\Delta x$ is an average grain size of said electroluminescent material.

4. The light source of claim 3, further comprising at least one continuous auxiliary transparent film layer which covers said electrodes and said strips of said electroluminescent material; a thickness $\Delta e$ of said electroluminescent film strips and a thickness $\Delta m$ of said auxiliary transparent film layer being related to the average grain size $\Delta x$ of the electroluminescent material as follows: $\Delta e > \Delta x$, $\Delta m \geqq \Delta e$, with $D > \Delta e$, $P \gg H$, $H > R$, wherein P is a thickness of the polymer sheath in said direction perpendicular to said longitudinal axis.

5. The light source of claims 4, wherein said row is arranged in a straight line.

6. The light source of claim 5, which is a flexible light source.

7. The light source of claims 2, wherein said connecting bodies contain a dielectric light-reflecting substance.

8. The light source of claims 2, wherein said connecting bodies contain a dielectric light-reflecting substance.

9. The light source of claims 4, wherein said row is arranged in a curved line.

10. The light source of claim 9, which is a flexible light source.

11. The light source of claims 1, wherein a quantitative ratio of said electroluminescent material to said binder is within the range of 1 to 5:1.

12. The light source of claims 1, wherein said dielectric separating blocks are composed of a material which contains a moisture-absorbing substance.

13. The light source of claims 1, wherein said dielectric separating blocks are composed of a material which contains a moisture-absorbing substance.

14. The light source of claim 1, wherein said electrodes are coated with an insulating coating.

15. The light source of claim 1, further comprising two elongated border bodies located each on each side of said system of said electrodes between a respective current conductive bus and a respective outermost electrode of said system, said elongated border bodies being composed of a dielectric material and auxiliary connecting bodies which connect said respective electrodes and bodies with an auxiliary film of an electroluminescent material extending in said longitudinal direction above a surface and at least on one side of said auxiliary connecting bodies.

16. The light source of claims 1, wherein said row is arranged in a plane.

17. The light source of claims 1, wherein said row is arranged in a curved surface.

18. The light source of claim 1 which is a flexible light source.

19. The light source of claim 10, wherein a material of said polymer sheath contains at least one of the components selected from the group consisting of a light scattering substance and a coloring substance.

20. The light source of claim 1, wherein said system of electrodes includes at least two groups of said electrodes arranged sequentially in a direction of said row, ends of some electrodes of each of said groups being connected to one of said conducting busses, and ends of remaining electrodes of said group are connected to another of said conducting busses.

21. The light source of claim 20, wherein said some electrodes are odd-numbered electrodes and said remaining electrodes are even-numbered electrodes.

22. A flexible electroluminescent light source having a longitudinal axis and comprising:

a core member including:

a system of a plurality electrodes extending along said longitudinal axis of said light source in form of a row of parallel stripes, each of said electrodes having a thickness in a direction perpendicular to the direction of said row longitudinal axis, said system of electrodes having on both sides outermost electrodes;

electrical insulating connecting bodies located between said electrodes, said connecting bodies connecting adjacent electrodes to each other, said electrodes being located at predetermined distances from each other, said connecting bodies being composed of a dielectric material in the form of strips having a thickness that is smaller than said thickness of any of said electrodes; and a layer of at least one powdered electroluminescent material dispersed in a dielectric binder and located between said electrodes, said layer of electroluminescent material being composed of strips extending in said longitudinal direction, having a transverse dimension in a direction perpendicular to said longitudinal direction, and located between said electrodes immediately above and at least on one side of said connecting bodies;

a plurality of current conducting busses connectable to a power supply source and electrically connected to said electrodes for supplying a current to said electrodes;

an insulating transparent polymer sheath covering said core and said current conducting busses, said current conducting busses being connected to said outermost electrodes through dielectric separating blocks; and two elongated border bodies located each on each side of said system of said electrodes between a respective current conductive bus and a respective outermost electrode of said system, said elongated border bodies being composed of a dielectric material;

auxiliary connecting bodies with an auxiliary film of an electroluminescent material extending in said longitudinal direction above and at least on one side of said auxiliary connecting bodies, said auxiliary connecting bodies connecting said respective elongated border bodies with said electrodes;

the following conditions being observed between dimensional parameters of said light source: $D \gg \Delta x$, $L > \Delta x$, $\Delta D > \Delta x$, with $R > D$, $H \gg D$, and $F \geqq H$, where D is a thickness of said electrodes in a direction perpendicular to said longitudinal direction, $\Delta D$ is a thickness of said electroluminescent layer, H is a width of said conducting busses in a direction of said row; R is a width of said elongated border bodies in the direction of said row, F is a distance from centers of said dielectric separating blocks to a respective current conducting bus, L is a distance between said electrodes; and $\Delta x$ is an average grain size of said electroluminescent material.

23. The light source of claim 22, further comprising at least one continuous auxiliary transparent film layer which covers said electrodes and said film strips of said electroluminescent material;

a thickness $\Delta e$ of said electroluminescent film strips and a thickness $\Delta m$ of said auxiliary transparent film layer being related to the average grain size $\Delta x$ of the electroluminescent material as follows: $\Delta e > \Delta x$, $\Delta m \geqq \Delta e$, with $D > \Delta e$, $P \gg H$, $H > R$, wherein P is a thickness of the polymer sheath in said direction perpendicular to said longitudinal axis.

24. The light source of claim 23, wherein a moisture-absorbing substance is added to the material of said dielectric separating blocks.

25. The light source of claim 23, wherein said row is arranged in a plane.

26. The light source of claims 23, wherein said row is arranged in a curved surface.

27. The light source of claim 26, wherein a material of said polymer sheath contains at least one of the components selected from the group consisting of a light scattering substance and a coloring substance.

28. The light source of claim 22, wherein said system of electrodes includes at least two groups of said electrodes arranged sequentially in a direction of said row electrically isolated from each other, ends of some electrodes of each of said groups being connected to one of said conducting busses, and ends of remaining electrodes of said group being connected to another of said conducting busses.

29. The light source of claim 28, wherein said some electrodes are odd-numbered electrodes and said remaining electrodes are even-numbered electrodes.

* * * * *